US007211968B2

(12) United States Patent
Adamson et al.

(10) Patent No.: US 7,211,968 B2
(45) Date of Patent: May 1, 2007

(54) LIGHTING CONTROL SYSTEMS AND METHODS

(75) Inventors: Hugh P. Adamson, Boulder, CO (US); Scott Hesse, Longmont, CO (US)

(73) Assignee: Colorado vNet, LLC, Loveland, CO (US)

( * ) Notice: Subject to any disclaimer, the term of this patent is extended or adjusted under 35 U.S.C. 154(b) by 301 days.

(21) Appl. No.: 10/899,874

(22) Filed: Jul. 27, 2004

(65) Prior Publication Data

US 2005/0035717 A1 Feb. 17, 2005

Related U.S. Application Data

(63) Continuation-in-part of application No. 10/631,387, filed on Jul. 30, 2003.

(51) Int. Cl.
*H05B 37/00* (2006.01)

(52) U.S. Cl. ..... 315/295; 315/316; 362/85

(58) Field of Classification Search ..... 315/294, 315/295, 296, 297; 362/85
See application file for complete search history.

(56) References Cited

U.S. PATENT DOCUMENTS

| | | | | |
|---|---|---|---|---|
| 5,289,496 | A | 2/1994 | Nakagawa et al. | |
| 5,675,221 | A | 10/1997 | Yoo et al. | |
| 5,751,118 | A | 5/1998 | Mortimer | |
| 6,005,490 | A * | 12/1999 | Higashihara | 340/825.72 |
| 6,020,825 | A | 2/2000 | Chansky et al. | |
| 6,288,501 | B1 * | 9/2001 | Nakamura et al. | 315/307 |
| 6,310,440 | B1 | 10/2001 | Lansing et al. | |
| 6,424,099 | B1 | 7/2002 | Kirkpatrick et al. | |
| 6,486,617 | B2 | 11/2002 | Pilz et al. | |
| 6,498,837 | B1 | 12/2002 | Baba | |
| 6,534,931 | B1 | 3/2003 | Konopka et al. | |
| 6,557,062 | B1 | 4/2003 | Shaler et al. | |
| 2002/0171379 | A1 * | 11/2002 | Adamson | 315/312 |
| 2003/0151909 | A1 * | 8/2003 | Sid | 362/85 |

OTHER PUBLICATIONS

"Introducing the Next Generation of Home Control Systems", 4 pgs., Advanced Control Technologies, Inc., Indianapolis, IN. Available at www.act-solutions.com at least Jul. 2004.
Internet Presentation, "Zwave: the wireless language", 18 pgs. Available at www.act-solutions.com at least Jul. 2004.
Adams, Jon, "What You Should Know about the ZigBee Alliance" Sensors Expo Workshop, Sep. 24, 2003, Anaheim Convention Center, Anaheim, CA (original Authorship 2002); 139 pgs.

* cited by examiner

*Primary Examiner*—David Vu
(74) *Attorney, Agent, or Firm*—Trenner Law Firm, LLC

(57) ABSTRACT

Implementations of lighting control systems and methods are described and claimed herein. An exemplary remote control system comprises a wireless interface configured to receive instructions from a wireless station in a building automation network. A ballast table identifying ballast control points is stored in computer-readable memory. A processor operatively associated with the wireless interface and the ballast table uses the ballast table to generate electronic control signals identifying ballast control points corresponding to the instructions received at the wireless interface.

6 Claims, 6 Drawing Sheets

LIGHTING CONTROL SYSTEMS AND METHODS

PRIORITY APPLICATION

This application claims priority as a continuation-in-part of co-owned U.S. patent application Ser. No. 10/631,387 for "CONTROL SYSTEMS AND METHODS" of Adamson, et al., filed Jul. 30, 2003, hereby incorporated herein for all that it discloses.

TECHNICAL FIELD

The described subject matter relates to lighting, and more particularly to lighting control systems and methods.

BACKGROUND

Artificial lighting in industrial countries currently consumes 27% to 40% of the electricity budget for both commercial and residential users. As a result new ways are being sought to reduce energy consumption associated with artificial lighting. One way of reducing energy consumption is to control the lighting based on time of day, usage patterns, by agreement with the utility company, etc. Controlling artificial lighting for other reasons (e.g., architectural emphasis, security, emergency situations, visual acuity, or scene illumination) is also becoming more commonplace and may be controlled based on one or more parameters (e.g., time, user preference).

Inexpensive dimmer switches are available which may be directly connected to one or more lights for controlling the luminance level or lighting intensity output by the lights. However, these switches are typically manually operable and therefore are not effective for scene control, energy savings, or more sophisticated uses (e.g., periodic or demand-based changes) on a regular basis.

More sophisticated systems are available, but require extensive wiring. Such systems are expensive to install and maintain. In addition, these systems typically cannot be operated using remote or wireless controls.

SUMMARY

Implementations of remote lighting control systems and methods are described herein, e.g., such as may be implemented in building automation. In an exemplary implementation, a remote lighting control system is provided comprising a wireless interface configured to receive instructions from a wireless station in a building automation network. A ballast table is stored in computer-readable memory to identify ballast control points. A processor is operatively associated with the wireless interface and the ballast table. The processor uses the ballast table to generate electronic control signals identifying ballast control points corresponding to the instructions received at the wireless interface.

In another exemplary implementation, a building automation network with remote lighting control system is provided. The building automation network comprises a CAN bus. A keypad device is connected to the CAN bus, the keypad issuing lighting commands over the CAN bus. A wireless station is also connected on the CAN bus, the wireless station converting lighting commands issued over the CAN bus by the keypad into wireless instructions, and the wireless station issuing wireless instructions. A remote lighting controller communicatively coupled to the wireless station generates electronic control signals for at least one ballast corresponding to control points for the at least one ballast based on the wireless instructions.

In yet another exemplary implementation, a method of remotely controlling at least one ballast in a building automation network is provided. The method may be implemented to: receive wireless instructions from a wireless station in the building automation network, determine ballast control points based on the wireless instructions, generate electronic control signals identifying the ballast control points based on the wireless instructions, and issue the electronic control signals to the at least one ballast.

DETAILED DESCRIPTION

The lighting control systems and methods described herein may be implemented in building automation networks and allows for a variety of remotely controllable lighting schemes. By way of example, a residence may use the control system for setting scenes (e.g., changing the lighting in a great room from a party atmosphere to a showing of the art on the walls). An apartment building may use control system for remote control and feedback (e.g., via a photo sensor) of the security lighting on the grounds. A multistory commercial building may use the control system to respond to a remote request from the utility company to lower the energy consumption (e.g., during peak usage or during a brownout).

The lighting control systems and methods may be readily installed using wireless communications, thereby reducing the cost of installation and materials (e.g., wiring). The lighting control systems and methods may also be seamlessly integrated with legacy building automation networks and with legacy ballasts and other lighting controls. The lighting control systems and methods are robust and "self-healing" (e.g., communications can be rerouted around failed devices).

Exemplary System

Figure 1:
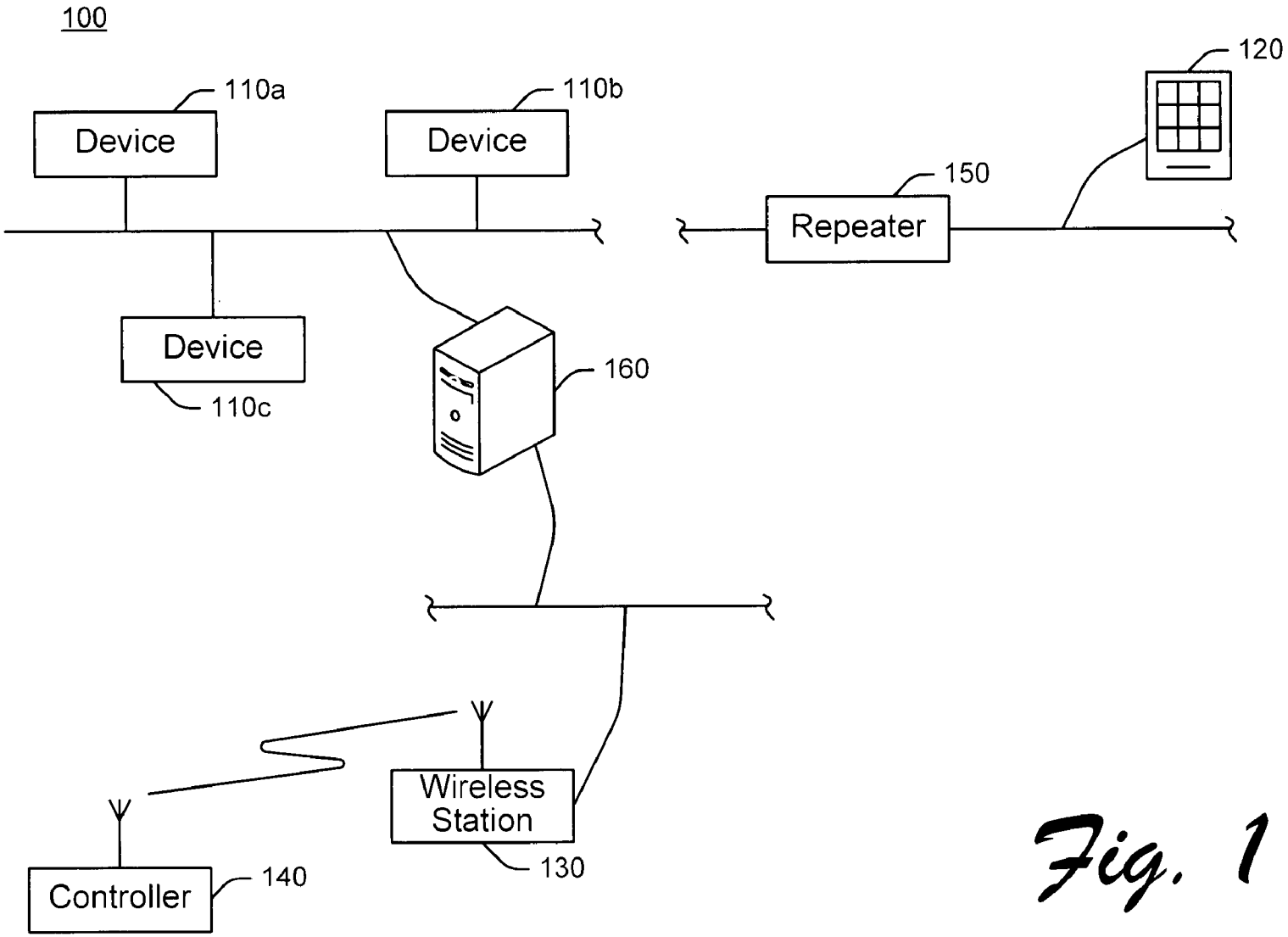
FIG. 1 is an illustration of an exemplary building automation network.

An exemplary building automation system 100 is shown in FIG. 1 as it may be used to automate various functions in a home or other building. For example, the building automation system 100 may be used to control lighting, heating, air conditioning, audio/visual output, operating window coverings to open/close, and security, to name only a few.

Building automation network 100 may include one or more automation devices 110*a–c* (hereinafter generally referred to as automation devices 110). In an exemplary implementation, automation devices 110 may include a keypad 120, wireless station 130, and remote controller 140

(e.g., a lighting controller). In operation a homeowner (or other user) may illuminate artwork hanging on the walls by pressing a key on the keypad 120 to lower the central lighting in a room (e.g., to 50% intensity) and raise the perimeter lighting (e.g., to 100% intensity), as will be described in more detail below.

In an exemplary implementation, automation devices 110 may execute computer-readable program code (including but not limited to scripts) to control various functions in the building automation network 100. Optionally, the program code may be changed in order to reprogram the automation devices 100.

It should be noted that the automation devices 110 may include any of a wide range of other types and configurations of devices, such as, e.g., security sensors, temperature sensors, light sensors, timers, touch pads, and voice recognition devices, to name only a few.

The automation devices 110 may be communicatively coupled in the building automation network 100 by a suitable communications protocol, such as, e.g., a CAN bus protocol, Ethernet, or combination thereof. For example, a CAN bus may be implemented in the building automation network 100 according to the CAN specification using a two-wire differential serial data bus.

The CAN specification is available as versions 1.0 and 2.0 and is published by the International Standards Organization (ISO) as standards 11898 (high-speed) and 11519 (low-speed). The CAN specification defines communication services and protocols for the CAN bus, in particular, the physical layer and the data link layer for communication over the CAN bus. Bus arbitration and error management is also described.

The CAN bus is capable of high-speed data transmission (about 1 Megabits per second (Mbits/s)) over a distance of about 40 meters (m), and can be extended to about 10,000 meters at transmission speeds of about 5 kilobits per second (kbits/s). It is also a robust bus and can be operated in noisy electrical environments while maintaining the integrity of the data.

Building automation network 100 may also comprise an optional repeater 150. Repeater 150 may be used, e.g., to extend the physical length of the CAN bus, and/or to increase the number of devices that can be provided in the building automation network 100. For example, repeater 150 may be implemented at the physical layer to amplify signals and/or improve the signal to noise ratio of the issued signals in the building automation network 100. Repeater 150 may also be implemented at a higher layer to receive, rebuild, and repeat messages.

Building automation network 100 may also include an optional bridge 160 to facilitate network communications, e.g., between a CAN bus and Ethernet network. The term "bridge" refers to both the hardware and software (the entire computer system) and may be implemented as one or more computing systems, such as a server computer.

The bridge 160 may also be used to perform various other services for the building automation network 100. For example, bridge 160 may be implemented as a server computer to process commands for the automation devices 110, provide Internet and email services, broker security, and optionally provide remote access to the building automation network 100.

It should be noted that the building automation network 100 is not limited to any particular type or configuration. The foregoing example is provided in order to better understand one type of building automation network in which the lighting control systems and methods described herein may be implemented. However, the lighting control systems and methods may also be implemented in other types of building automation systems. The particular configuration may depend in part on design considerations, which can be readily defined and implemented by one having ordinary skill in the art after having become familiar with the teachings of the invention.

Figure 2:
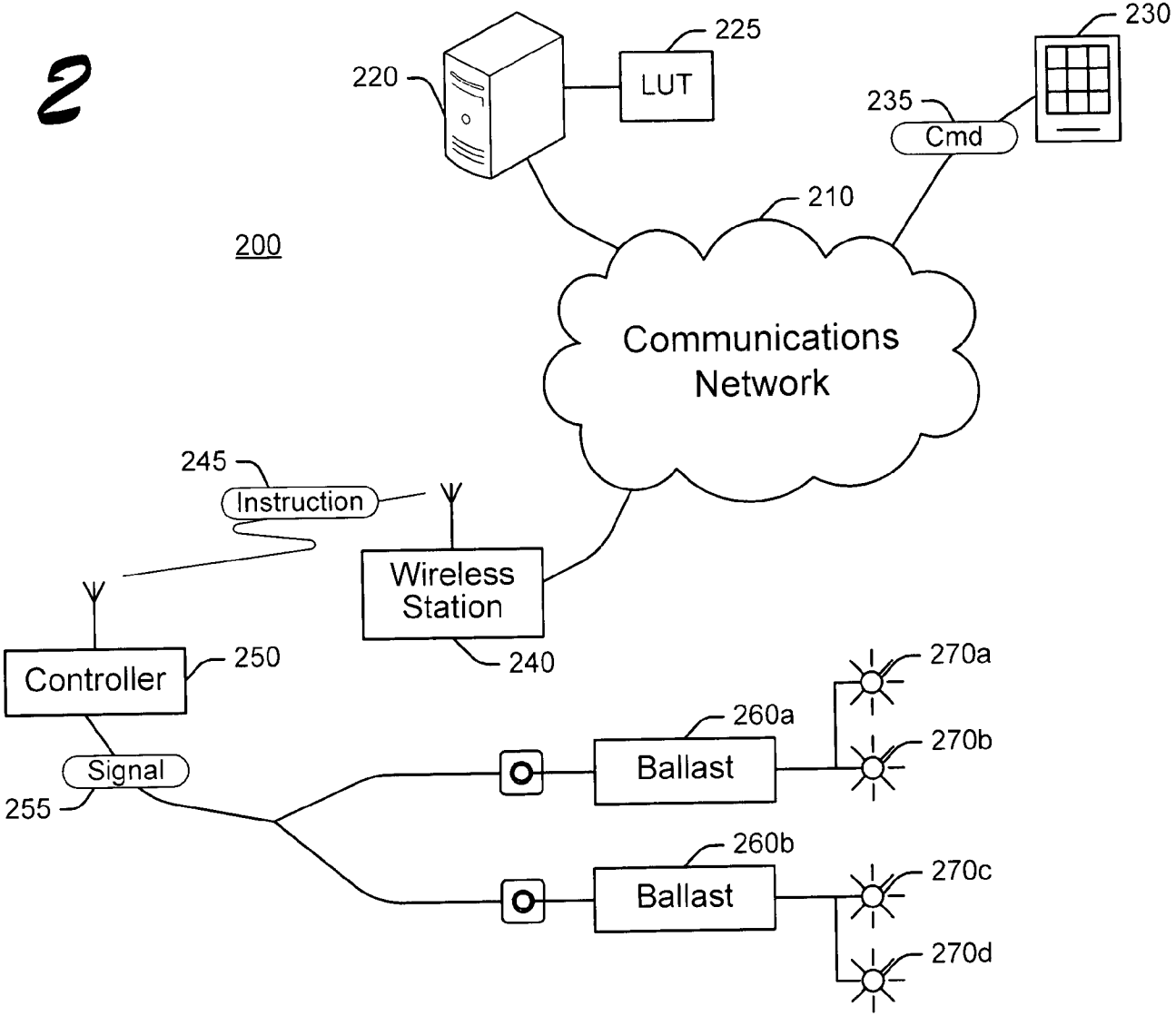
FIG. 2 is an illustration of an exemplary lighting controller as it may be implemented in a building automation network.

FIG. 2 is an illustration of an exemplary lighting controller as it may be implemented in a building automation network. The building automation network 200 may include a communication network 210 and server or bridge 220. In addition, building automation network 200 may also include, among other automation devices, a keypad 230 communicatively coupled to a wireless station 240 via the communications network 210. The wireless station 240 may be linked to a remote lighting controller 250 via a wireless application protocol (WAP).

Remote lighting controller 250 may be coupled to one or more lighting ballasts 260*a–b* for one or more lamps 270*a–d*. Lighting ballasts 260*a–b* provide a starting voltage and/or stabilize the current in a lighting circuit such as those used with fluorescent lamps.

In operation, the homeowner (or other user) may adjust the lighting level in a room by pressing one or more keys on the keypad 230. Keypad 230 issues a command 235, e.g., onto the CAN bus in communication network 210. The commands may include a Device ID identifying the device which issued the command (the keypad in this example). An input ID field may also be included to identify one or more keys which were pressed.

The command 235 may be received directly at the wireless station 240. Alternatively, the command 235 may first be received by the bridge 220 and then routed to the wireless station 240. Computer-readable program code may be provided to execute at wireless station 240 or on the bridge 220 to convert commands 235 into one or more instructions 245 which may be transmitted wirelessly to the controller 250.

In an exemplary implementation, the program code may access a lookup table (LUT) 225 residing in computer-readable storage or memory (e.g., at the bridge 220 or wireless station 240) to generate the instructions 245. LUT 225 may be implemented as a data structure and includes information corresponding to various commands that may be used to generate the instructions.

For purposes of illustration, the keypad command 235 may include a Device ID field identifying the source of the command (e.g., Keypad Ser. No. 45375), and an Input ID field identifying the key that the user pressed (e.g., Key 1). The corresponding instructions 245 for this keypad command 235 may be to raise the main lighting in the bedroom to 75% and turn off the perimeter lighting in the bedroom.

Before continuing it is noted that the information included in LUT 225 may be based on the needs and desires of the building occupant(s). Optionally, the information included in LUT 225 may be reconfigured based on the changing needs and/or desires of the building occupant(s).

The wireless station 240 issues the instructions to the remote lighting controller 250, e.g., as a radio frequency (RF) signal or other suitable wireless protocol (e.g., BLUETOOTH®, ZigBee and the IEEE 802.15.4 standards for wireless communications). The remote lighting controller 250 generates electronic control signals 255 based on the instructions received from the wireless station 240. Electronic control signals 255 may be digital or analog, depending on the requirements of the ballasts 260*a–b*. The remote lighting controller 250 is described in more detail with reference to FIG. 3.

Figure 3:
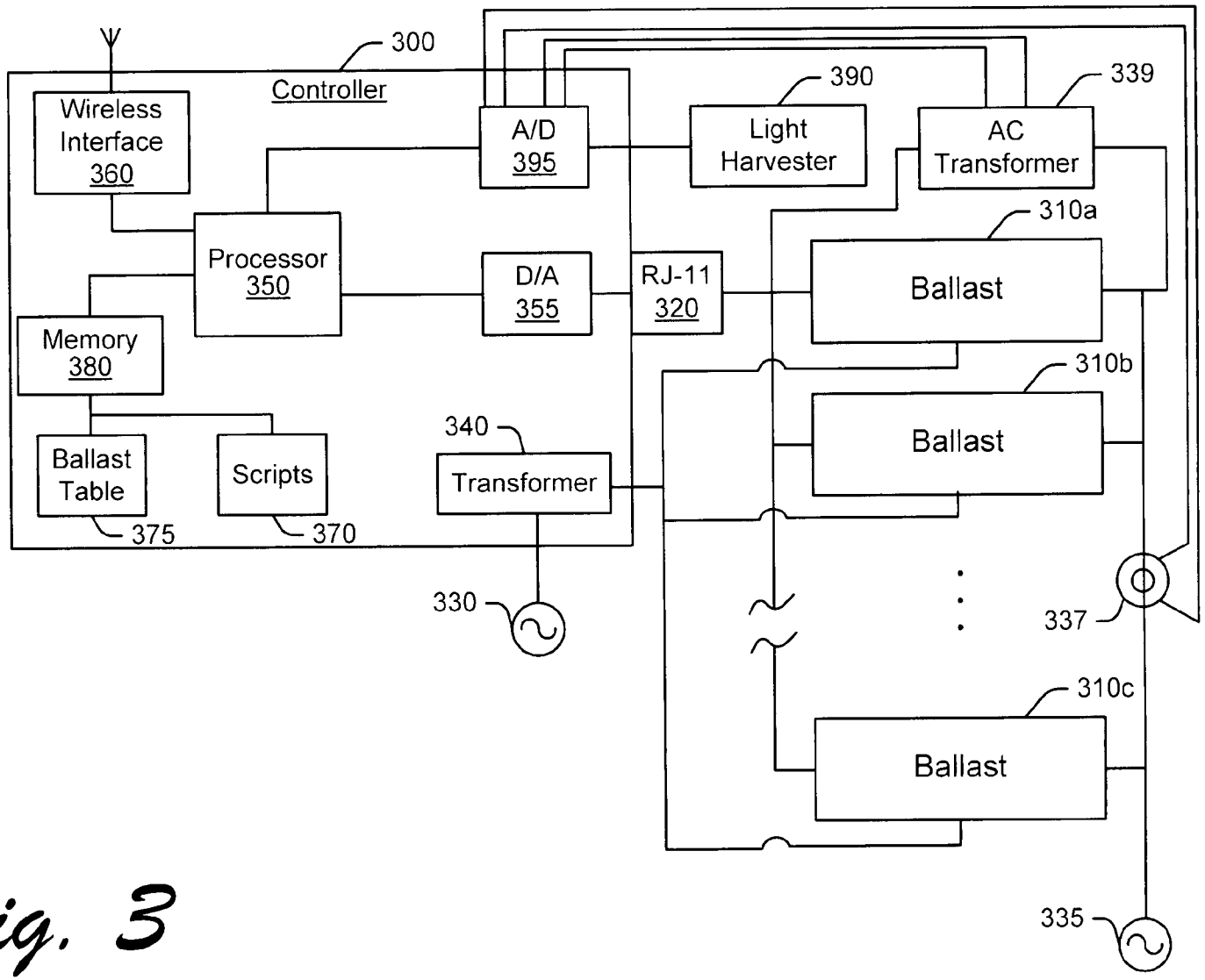
FIG. 3 is a schematic diagram of an exemplary lighting controller.

FIG. 3 is a schematic diagram of an exemplary lighting controller. Briefly, controller 300 generates electronic control signals based at least in part on wireless instructions received at the controller 300. The electronic control signals may be output to one or more lighting ballasts 310*a–c* connected to the controller 300 via a suitable connector (e.g., RJ-11 connector 320) to control lighting levels.

Before continuing it is noted that controller 300 may be powered by an optional auxiliary power supply 330 and/or by power provided to the ballasts 310*a–c* (e.g., from power supply 335). Controller 300 may include a transformer 340 to convert alternating current (AC) or voltage from either or both power supplies 330, 335 into direct current (DC) for use by the controller 300.

Providing auxiliary power for controller 300 may be advantageous, for example, where the user has negotiated a power-use agreement with the utility company. Such agreements typically require that the user does not exceed a power usage threshold for predetermined times (e.g., peak use times). Auxiliary power for the controller 300 allows the controller 300 to maintain its configuration and the lights at the user's facilities are returned to the predetermined level even if electrical power from the ballasts (e.g., power supply 335) fails or is removed and then reinstated.

It is also noted that an AC current transformer 337 may be provided in series or over the wire. As AC current flows through the wire it creates a corresponding current in the transformer coil and with the load resistor (R) a voltage linear to the current can be determined. This voltage is small enough for an A/D (e.g., A/D 395) to process, and using a look up table (e.g., a LUT stored in memory 380), the processor 350 may determine the AC current being provided to the ballasts 310.

Another AC transformer 339 may also be provided and converts the higher voltage to a lower, but linear representation of the original VAC. Thus, 240V goes to 2.4V and 120V goes to 1.2V. Again, this can be input to the processor 350 and a LUT used to determine actual VAC on the line.

Accordingly, the combination of current times (*) voltage gives power and controller is able to monitor power in the ballasts. This information may also be returned to the building automation system (e.g., the bridge or central control) for further processing and/or response.

Of course the controller 300 is not limited to any power supply configuration. In other exemplary implementations, electrical power may be provided by an internal power source (e.g., a battery) or other backup or uninterruptible power supply (UPS). Alternatively, the controller 300 may be powered by the same electrical power source that is provided for the building's electrical wiring system.

It is also noted that controller 300 may also be provided with various ancillary circuitry, for example, electronic controls, input/output (I/O) registers, etc. Some of this circuitry is described in the parent application referenced above. Other circuitry is well-understood and therefore not shown or described herein as further description is not needed for a full understanding of or to practice the invention.

Controller 300 includes one or more processing units or processor 350 for generating electronic control signals based on the wireless instructions. Processor 350 may be operatively associated with a wireless interface 360 for communicatively coupling with one or more wireless stations to receive wireless instructions from the building automation network. By way of example, wireless interface 360 may be a 2.4 GHz remote frequency (RF) receiving module complying with the ZigBee and IEEE 802.15.4 standards for wireless communications.

Controller 300 also includes computer-readable program code 370 (e.g., scripts) residing in computer-readable storage or memory 380 operatively associated with processor 350. The program code 370 may be executed by processor 350 to generate electronic control signals based at least in part on the wireless instructions received at the controller 300.

In an exemplary implementation, the program code 370 may be executed to access a ballast table 375 and determine control points for one or more ballasts based on the wireless instructions. Ballast table 375 may be implemented as a data structure including control points for one or more ballasts 310*a–c*. For example, the ballast table 375 may include control points such as 50% intensity, or a light level specified in lumens. The ballast table 375 may also include control points which allow the lights to be slewed on over time to the desired lighting intensity.

It is noted that the ballast table 375 may be generated and/or changed remotely and stored, e.g., on the bridge or at offsite storage. Updates to the ballast table 375 may be downloaded to the controller 300, making the light control system and methods disclosed herein robust and readily changeable.

Controller 300 may be used with a number of different types of ballasts 310 and may be provided with cross-reference capability. For example, ballast table 375 may include different types of ballasts 310 and corresponding output for controlling the ballasts 310. By way of example, a 10 bit D/A converter may be used to control 1024 luminescent lighting levels. A 12 bit D/A converter may be used to control 4096 variable combinations of lighting levels.

The following is illustrative of control points for different types of ballasts 310 that may be used with controller 310. The Osram Sylvania dimming ballast operates on an analog voltage scale of about 1 to 6 volts. For example, on one end of the scale an analog voltage signal of 1 volt may correspond to a 10% lighting intensity and on the other end of the scale an analog voltage signal of 6 volts may correspond to a 100% lighting intensity.

As another example, the Easylite ballast operates on a reverse polarity analog voltage scale of about 1.8 to 8.8 volts. On one end of the scale, an analog voltage signal of 1.8 volt may correspond to a 100% lighting intensity and on the other end of the scale an analog voltage signal of 8.8 volts may correspond to a 10% lighting intensity. An analog voltage signal of 12 volts corresponds to a 0% lighting intensity, or a shut-off condition.

Controller 300 may include suitable interface circuitry, such as, e.g., a digital to analog (D/A) converter 355, which formats output from the processor 350 for use by various ballasts 310. Accordingly, controller 300 may be used with any of a wide variety of ballasts 310 that operate according to different control protocols. By way of example, interface circuitry may be provided to convert digital output signals to DC voltage signals (e.g., 0 to 10 volts DC), DC current signals, pulse-width modulated (PWM) signals, line voltage carrier signals, radio frequency (RF) signals, and signals for proprietary controller protocols (e.g., LON WORKS, CE Bus), or even digital signals.

In addition, program code 370 (e.g., firmware) may be provided for processor 350 for switching between voltage control or current control modes of operation so that the controller 300 may be used with different types of ballasts 310. Indeed, the program code may configure the same interface circuitry to control more than one type of ballast 310 (e.g., for different lighting zones).

For example, interface circuitry may be provided to convert digital output signals to analog voltage configuration signals in the range of 1 to 6 volts for Osram Sylvania regulators. The same interface circuitry may be also used to convert digital output signals to analog voltage configuration signals in the range of 1.8 to 12 volts for Easylite regulators. Exemplary interface circuitry is shown and described in the parent patent application referenced above.

Controller 300 may also include a light harvester 390 (e.g., an AC current coil) operatively associated with the processor 350 via analog to digital (A/D) converter 395. Light harvester 390 may be used to provide feedback to controller 300 for adjusting the lighting level. For example, light harvester 390 may issue a signal to controller 300 to turn off or turn down the lighting during daylight hours.

As another example, the wireless instructions may include desired lighting intensity levels which may vary on a number of factors including the age of the lamps (e.g., older lamps may not provide as much lighting). Accordingly, controller 300 may adjust the lighting to the desired intensity level based at least in part on feedback from the light harvester 390. If the actual output of the lamps is not within a predetermined range (e.g., ±5 lumens) based on feedback from the light harvester 390, controller 300 may adjust the lighting intensity to be within the predetermined range. It should be noted that the decision to adjust the light intensity based on feedback from one or more light harvesters may be made, e.g., by the bridge and/or at the controller itself.

These exemplary implementations allow the predetermined lighting level to be maintained in the room even as the lamps age and experience lumen depreciation (i.e., decreased lighting output). Such embodiments are also advantageous, for example, where the user wants to control the overall light intensity in a room that includes lighting from other sources (e.g., sunlight, other lighting circuits) and not just the intensity level of the lamps themselves.

Exemplary Operations

Described herein are exemplary methods for implementing remote lighting control. The methods described herein may be executed in hardware and/or as computer readable logic instructions. In the following exemplary operations, the components and connections depicted in the figures may be used to implement the remote lighting control.

Figure 4:
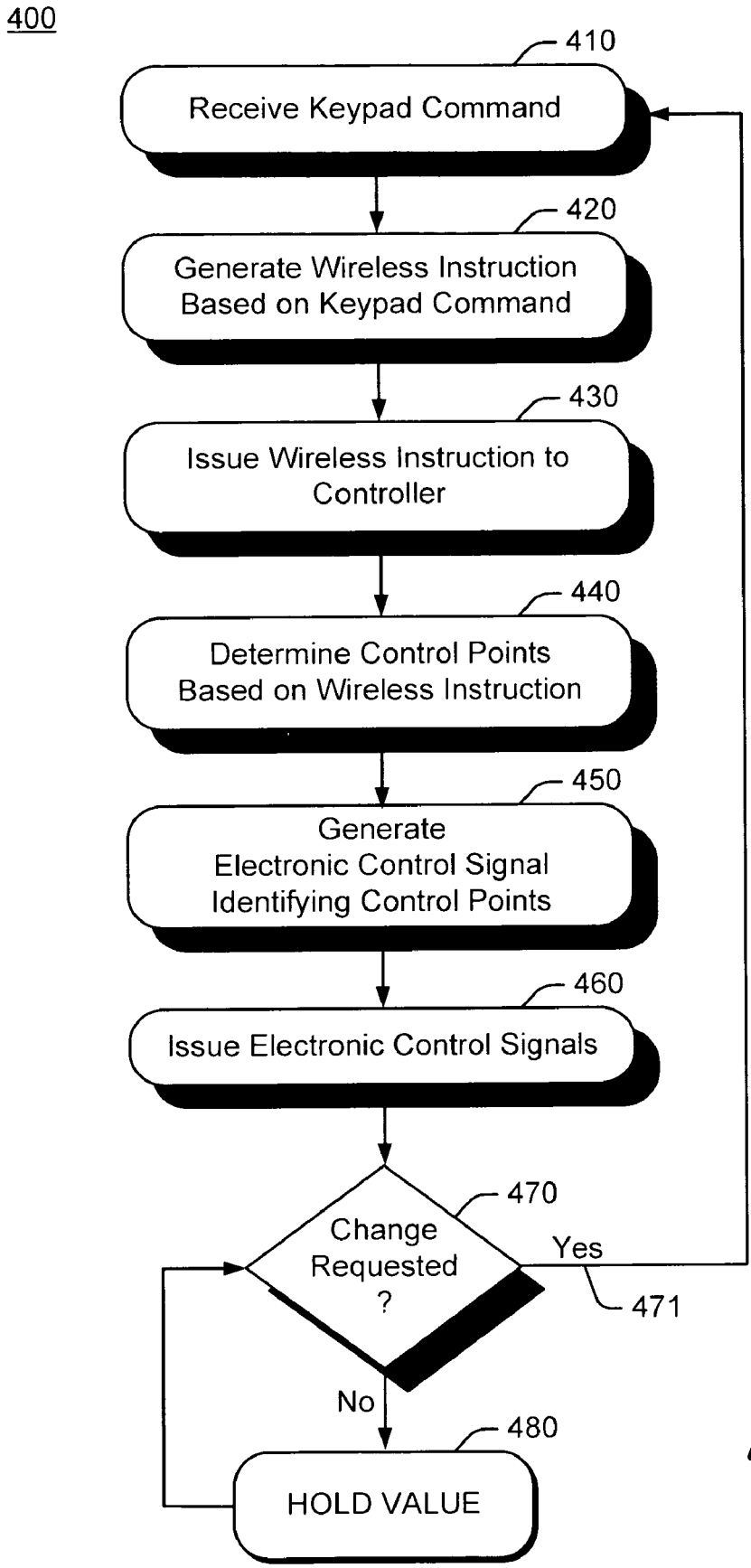
FIG. 4 is a flowchart illustrating exemplary operations that may be implemented for lighting control.

FIG. 4 is a flowchart illustrating exemplary operations that may be implemented for lighting control. For example, the operations 400 may used to remotely control one or more ballasts in a building automation network. In operation 410 a keypad command is received, e.g., at a bridge or at a wireless station in a building automation network. In operation 420, wireless instructions are generated based on the keypad command. For example, the bridge may generate wireless instructions and issue these to the wireless station. Alternatively, the wireless station may receive the keypad command and generate the wireless instructions.

The wireless instructions are issued to a controller in operation 430. In operation 440 the controller determines control points based on the wireless instructions. In operation 450 the controller generates electronic control signals identifying the control points. In operation 460 the controller issues the electronic control signals, e.g., to one or more ballasts to control lighting.

Optionally, in operation 470 the controller maintains substantially constant output to the device unless a change is requested. That is, operations return at 471, e.g., if another keypad command is received or feedback from a light harvester indicates a need to increase the lighting level. However, in operation 480 the controller maintains the last output value for the device until another instruction is received. For example, even in the event of a power failure or device reset the controller may return the ballasts to the prior lighting level.

Alternative Implementations

Figure 5:
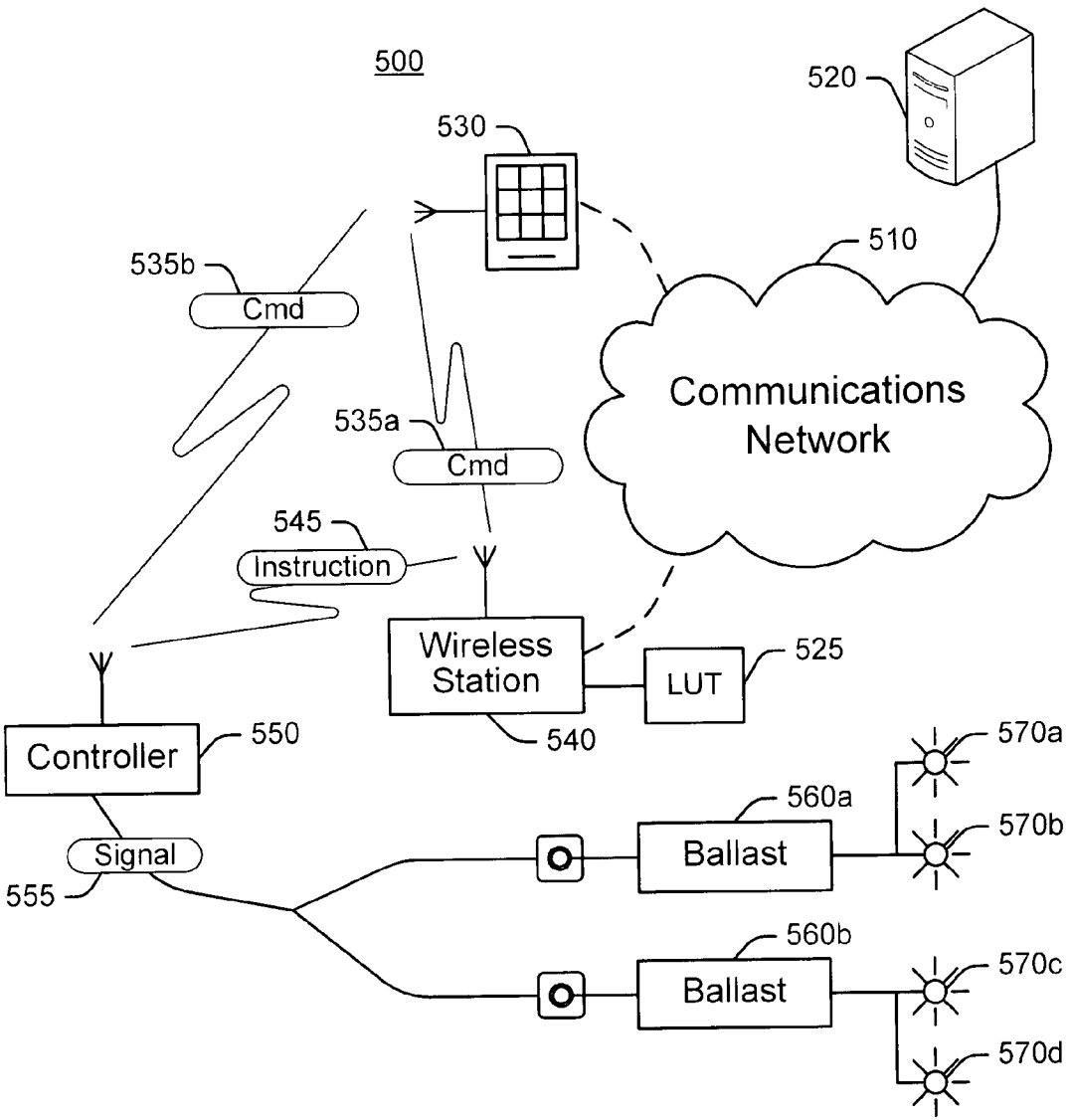
FIG. 5 is another illustration of an exemplary lighting controller as it may be alternatively implemented in a building automation network.

FIG. 5 is another illustration of an exemplary lighting controller as it may be alternatively implemented in a building automation network. It is noted that 500-series numerals are used and correspond to like components in FIG. 2.

In the alternative implementation shown in FIG. 5, a keypad 530 (or other control device) may include a wireless transmitter. Accordingly, the keypad 530 may be used to generate and issue wireless command signals 535*a* directly to one or more wireless stations 540 and/or issue wireless command signals 535*b* directly to one or more controllers 550.

It is noted that keypad 530 and wireless station 540 are shown connected to the communications network 510 in FIG. 5 by dashed lines. In some implementations, the keypad 530 and wireless station 540 may be stand-alone devices which are not connected to any communications network 510 and only communicate with other wireless devices.

The wireless command signals 535 may be broadcast to one or more wireless stations 540. In such an implementation, only the wireless stations 540 which recognize and can process the wireless command signals 535 respond to the wireless command signals 535. Other wireless stations 540 which may receive the broadcast signals do not respond. Alternatively, the wireless command signals 535 may be addressed to specific wireless stations 540.

The wireless stations 540 may also serve as routers for the wireless command signals 535. For example, a first wireless station 540 may receive a wireless command signal 535 and then issue the wireless command signal 535 to another wireless station (not shown). Such an implementation is referred to as auto-networking and may be used to increase transmission distances and/or to reroute wireless command signals 535 when one or more wireless stations are not responding (e.g., a failed device).

Wireless implementations such as those shown and described in FIG. 5 may be provided, e.g., in a legacy a building automation network 500 to reduce or eliminate the need to replace the existing devices and/or wiring.

Figure 6:
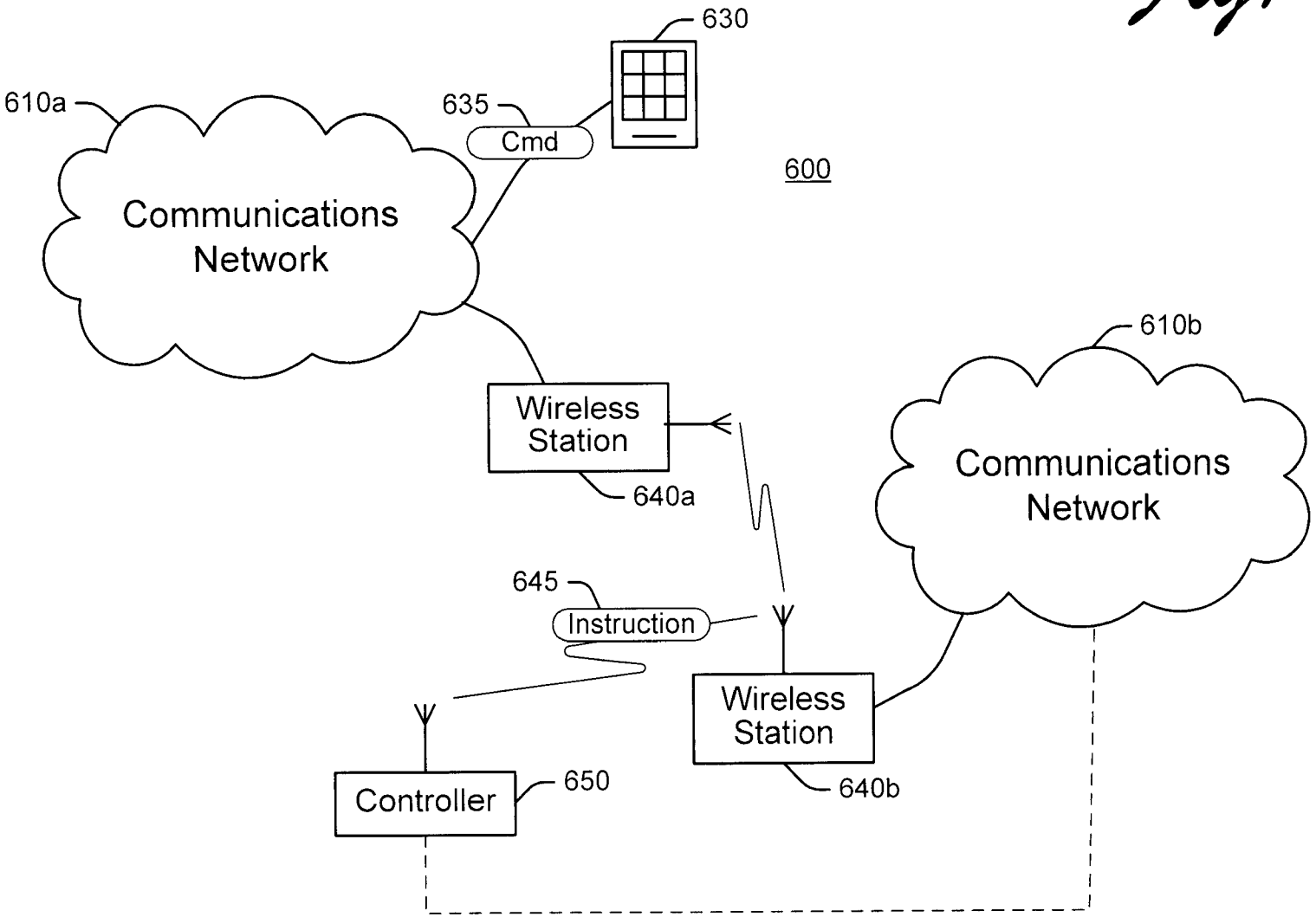
FIG. 6 is another illustration of an exemplary lighting controller as it may be alternatively implemented in a building automation network.

FIG. 6 is another illustration of an exemplary lighting controller as it may be alternatively implemented in a building automation network. It is noted that 600-series numerals are used and correspond to like components in FIG. 2.

Building automation network 600 may include a plurality of communications networks 610*a* and 610*b*. Although only two communications networks are shown for purposes of illustrations, yet additional communications networks may also be provided. In such an implementation, a command 635 issued by keypad 630 (or other device) on a first communications network 610*a* may be delivered via a first wireless station 640*a* to a second wireless station 640 in a second communications network 610*b*. An instruction 645 corresponding to the keypad comment 635 may then be issued to the controller 650 wirelessly by the second wireless station 640*b*. Alternatively, instruction 645 may be issued to the controller 650 via communications network 610*b* (shown connected to the controller 650 by a dashed line in FIG. 6).

In addition to the specific implementations explicitly set forth herein, other aspects and implementations will be apparent to those skilled in the art from consideration of the specification disclosed herein. It is intended that the specification and illustrated implementations be considered as examples only, with a true scope and spirit of the following claims.

What is claimed is:

1. A building automation network with remote lighting control system comprising:

a CAN bus;

a keypad device connected to the CAN bus, the keypad issuing lighting commands over the CAN bus;

a wireless station connected to the CAN bus, the wireless station converting lighting commands issued over the CAN bus by the keypad into wireless instructions, and the wireless station issuing the wireless instructions; and a remote lighting controller communicatively coupled to the wireless station, the remote lighting controller generating electronic control signals for at least one ballast corresponding to control points for the at least one ballast based of the wireless instructions.

2. The building automation network with remote lighting control system of claim 1, further comprising a wireless interface at the remote lighting controller, the wireless interface receiving the wireless instructions from the wireless station.

3. The building automation network with remote lighting control system of claim 1, further comprising a ballast table stored in computerreadable memory at the remote lighting controller, the ballast table identifying the control points.

4. The building automation network with remote lighting control system of claim 1, further comprising a processor at the remote lighting controller, the processor generating the electronic control signals.

5. The building automation network with remote lighting control system of claim 1, wherein said lighting controller provides substantially constant electronic control signals to the at least one ballast until another instruction is received.

6. The building automation network with remote lighting control system of claim 1, further comprising scripts stored in computerreadable memory at the lighting controller, the scripts executing to generate the electronic control signals.

* * * * *